US009790648B2

(12) United States Patent
Buschmann et al.

(10) Patent No.: US 9,790,648 B2
(45) Date of Patent: Oct. 17, 2017

(54) METHOD FOR LAYING DOWN A PAVEMENT, A SCREED AND A ROAD PAVER

(71) Applicant: JOSEPH VOGELE AG, Ludwigshafen (DE)

(72) Inventors: Martin Buschmann, Neustadt (DE); Gunter Zegowitz, Bad Konig (DE); Achim Eul, Mannheim (DE); Ralf Weiser, Ladenburg (DE); Roman Munz, Neustadt (DE); Nicole Angermann, Bruhl (DE); Klaus Bertz, Dittelsheim-Hessloch (DE); Christian Pawlik, Neustadt (DE)

(73) Assignee: JOSEPH VOGELE AG, Ludwigshafen/Rhein (DE)

( * ) Notice: Subject to any disclaimer, the term of this patent is extended or adjusted under 35 U.S.C. 154(b) by 289 days.

(21) Appl. No.: 14/542,326

(22) Filed: Nov. 14, 2014

(65) Prior Publication Data

US 2015/0139730 A1 May 21, 2015

Related U.S. Application Data

(62) Division of application No. 12/949,889, filed on Nov. 19, 2010, now Pat. No. 8,998,530.

(30) Foreign Application Priority Data

Nov. 20, 2009 (EP) ..... 09014516
Mar. 18, 2010 (EP) ..... 10002895

(51) Int. Cl.
*E01C 19/00* (2006.01)
*E01C 19/40* (2006.01)
(Continued)

(52) U.S. Cl.
CPC ..... *E01C 19/004* (2013.01); *B06B 1/164* (2013.01); *E01C 19/002* (2013.01); *E01C 19/34* (2013.01);
(Continued)

(58) Field of Classification Search
CPC ..... E01C 19/002; E01C 19/34; E01C 19/38; E01C 19/40; E01C 19/42; E01C 19/4833; E01C 19/4853
See application file for complete search history.

(56) References Cited

U.S. PATENT DOCUMENTS 1,898,158 A 2/1933 Winkler
3,508,475 A * 4/1970 Smith ..... E01C 19/40 404/102
(Continued)

FOREIGN PATENT DOCUMENTS

DE 3127377 A1 1/1983
EP 374428 A1 6/1990
(Continued)

*Primary Examiner* — Matthew D Troutman
(74) *Attorney, Agent, or Firm* — Fish & Richardson P.C.

(57) ABSTRACT

Method for laying down a pavement consisting of paving material with a road paver screed in which a compaction unit pre-compacts the paving material at cyclical work cycles with a selectable stroke and at a selectable frequency while the pavement is laid down at a selectable paving speed and at least the stroke is automatically adjustable in response to paving parameters.

6 Claims, 5 Drawing Sheets

(51) Int. Cl.

| | |
|---|---|
| ***E01C 19/48*** | (2006.01) |
| ***B06B 1/16*** | (2006.01) |
| ***E01C 19/34*** | (2006.01) |
| ***E01C 19/42*** | (2006.01) |
| ***E01C 23/06*** | (2006.01) |

(52) U.S. Cl.

CPC ..... *E01C 19/407* (2013.01); *E01C 19/42* (2013.01); *E01C 19/4833* (2013.01); *E01C 19/4853* (2013.01); *E01C 23/06* (2013.01); *E01C 2301/14* (2013.01)

(56) References Cited

U.S. PATENT DOCUMENTS

| | | | | |
|---|---|---|---|---|
| 3,545,349 | A * | 12/1970 | Gottfried | E01C 19/4853 404/118 |
| 4,493,585 | A | 1/1985 | Axer | |
| 4,502,813 | A | 3/1985 | Hojberg | |
| 4,507,014 | A | 3/1985 | Heims et al. | |
| 4,828,428 | A | 5/1989 | Anderson | |
| 5,165,820 | A | 11/1992 | Bunk et al. | |
| 5,401,115 | A | 3/1995 | Musil et al. | |
| 6,238,135 | B1 | 5/2001 | Rower | |
| 6,551,018 | B2 | 4/2003 | Baker et al. | |
| 6,932,538 | B2 | 8/2005 | Heims | |
| 7,540,686 | B2 | 6/2009 | Heims | |
| 9,487,924 | B2 * | 11/2016 | Bertz | E01C 19/4853 |
| 2002/0141823 | A1 | 10/2002 | Baker et al. | |
| 2002/0168226 | A1 | 11/2002 | Feucht et al. | |
| 2011/0123270 | A1 * | 5/2011 | Buschmann | E01C 19/407 404/133.05 |
| 2015/0225909 | A1 * | 8/2015 | Bertz | E01C 19/38 404/102 |

FOREIGN PATENT DOCUMENTS

| | | | |
|---|---|---|---|
| EP | 1310598 | A2 | 5/2003 |
| EP | 1905899 | A2 | 4/2008 |
| GB | 2091792 | A | 8/1982 |
| JP | 3150927 | A | 3/1999 |
| JP | 2002021016 | A | 1/2002 |
| JP | 2003129413 | A | 5/2003 |
| JP | 2008106514 | A | 5/2008 |
| WO | WO0070150 | A1 | 11/2000 |

* cited by examiner

METHOD FOR LAYING DOWN A PAVEMENT, A SCREED AND A ROAD PAVER

BACKGROUND OF THE INVENTION

The present invention relates to a method for laying down a pavement consisting of paving material on a subgrade with a screed of a road paver in which a compaction unit of the screed pre-compacts the paving material in the course of cyclical work cycles having a selectable stroke and a selectable frequency while laying down pavement having a selectable pavement thickness at a selectable paving speed for road pavers; a screed for road pavers having a compaction unit with a tamper bar that is drivable in cyclical work cycles with a selectable stroke and a selectable frequency for pre-compacting a pavement made from paving material; and a road paver comprising at least one screed mounted on traction bars that are articulated to the road paver and the articulation points thereof are vertically adjustable with leveling cylinders and the screed comprising a compaction unit having at least one tamper that is operable with a selectable stroke and a selectable frequency.

When a pavement of bituminous or concrete-type paving material is laid down with a road paver, the floatingly towed screed should compact the paving material over the whole pave width as uniformly as possible and generate a continuous or closed flat structure. The compaction unit, e.g. a so-called tamper or a tamper and an eccentric vibrator, should generate a precompaction that is as high, uniform and constant over the pavement thickness as possible, so that different or varying pavement thicknesses have no significant impact on the final compaction. Stroke and frequency of the tamper influence the precompaction and floating behavior of the screed. The greater the stroke, the higher is the precompaction and the greater is the precompaction depth. The frequency can be adjusted individually in an infinitely variable way. EP 0 493 644 A discloses that e.g. the tamper frequency is adjusted in response to the paving speed. Furthermore, it is expedient when the tamper stroke is adapted to the pavement thickness such that the screed can perform paving with a positive setting angle that is as small as possible. If the stroke for the pavement thickness is too large, this may create a negative setting angle of the screed, possibly resulting in an open cracked surface structure or uncontrollable leveling behavior of the screed, with ensuing irregularities. The pavement thickness is e.g. predetermined by the setting of the height position of the traction points of the screed on the road paver. Likewise, the frequency and the paving speed must be matched with one another. So far the matching operation has been chosen individually such that the screed performs the paving operation at a positive setting angle that is as small as possible. On the other hand, the paving speed defines the action of the compaction unit on the surface. The paving speed must be chosen such that a material supply that is as constant as possible is ensured by the transport vehicles. Since the paving speed has a great influence on precompaction, it should be ensured that the screed performs the paving operation at a small positive setting angle so as to guarantee high evenness, i.e. the paving speed used must permit a high precompaction. The stroke has so far been set manually in several steps, with the paving operation having to be interrupted in each step. Each stroke step, however, just constitutes a compromise because it only fits one pavement thickness. For instance, a larger quantity of paving material is pre-compacted by the tamper bar due to an increase in stroke within the set pavement thickness. Precompaction can also be increased by increasing the frequency. In specific cases the tamper can cooperate with an additional eccentric vibration device in the screed so as to achieve even higher precompaction and evenness.

Starting from the information brochure "Für jede Aufgabe die richtige Einbaubohle" ["For each task the right screed"] of the company Joseph Vögele AG, 68146 Mannheim/Germany, No. 2400/10/2.1997, page 4, it is known that the stroke of the compaction unit including a tamper is adjusted manually in that an eccentric bush which is rotatable in a connecting rod driving the tamper bar is rotated relative to an eccentric section of the driving eccentric shaft. The eccentric bush is clamped on the eccentric section of the eccentric shaft and thereby coupled with the eccentric section in a rotationally fixed manner and can be rotated after release of a clamping screw relative to the eccentric section and can be fixed again. The eccentric shaft is driven by a hydromotor having a speed that is e.g. infinitely variable. If prior to the paving work a specific pavement thickness is set, the stroke is then adjusted to this pavement thickness. If the pavement thickness is changed, the paving work must be interrupted and the stroke must be adapted to the new pavement thickness. Since the pavement thickness can also vary during the ongoing paving operation by reason of external influences, the set stroke does often not fit the pavement thickness, whereby the precompaction varies and the setting angle of the screed can change and, as a consequence, evenness and surface quality of the pavement will deteriorate. The adjusting operation is time-consuming and troublesome for the reason that e.g. eight connecting rods may be provided in the base screed alone, and the adjusting operation must be carried out with great care to perform a uniform precompaction operation over the work width.

DE 198 36 269 A discloses a method for varying the frequency of the tamper in response to the setting angle of the screed, wherein the setting angle of the screed is continuously sensed via at least one sensor. The frequency is adjusted automatically whereas other machine parameters are set by an operator in response to the respective paving parameters.

DE 40 40 029 A discloses a method in which during paving the frequency of the tamper is varied depending on the actual paving speed. Other machine parameters are set by the operator as an additional measure. For instance, the stroke of the tamper must be set manually prior to paving or during an interruption of the paving work. This is tantamount to a considerable work load for the operator and calls for great expertise.

SUMMARY OF THE INVENTION

It is the object of the present invention to indicate a method of the aforementioned type as well as a screed and a road paver that provide for a uniformly high quality of a laid pavement, e.g. the laying of a pavement with a thickness which is uniform in the work travel direction and a compaction which is uniform both in the work travel direction and in a direction transverse thereto.

This object is achieved with the pavement laying method.

Since at least the stroke of the compaction unit is automatically adjusted in response to at least one paving parameter, such as at least the paving speed and/or pavement thickness, the stroke and the respective paving parameter are in an optimal relationship with each other, resulting not only in a predominantly constant precompaction independently of variations of the paving parameters, but also in the maintenance of an optimally small positive setting angle of the screed that ensures a closed and flat surface of the pavement and a constantly high quality of the laid pavement. The adjustments can be made comfortably on all connecting rods at the same time.

In the screed the adjusting mechanism which is preferably even operable during the paving work makes it possible to adjust the stroke of the compaction unit in such a manner that the stroke, for instance before or during changes in the paving speed and/or the pavement thickness, as occur during the paving operation either due to external influences or are made with intention, respectively fits the paving speed and/or the pavement thickness substantially in an optimum way, which results in an optimum and constant precompaction and high quality of the laid pavement. If during the laying work the stroke can be adjusted, expediently in all connecting rods, the paving operation need not be interrupted for any stroke adjustment, and the work load for the personnel is reduced. The driver of the road paver or an operator on the screed can carry out the adjustment alternatively in case of need. Particularly expediently, however, the adjusting operation is carried out automatically in response to paving parameters, such as the paving speed and/or pavement thickness, so that a uniform high end quality of the pavement is achieved without any significant intervention by the personnel.

The road paver which is used for carrying out the method and is equipped with this screed makes it possible to achieve a uniformly high quality for a laid pavement thanks to the control system and thanks to control variables that are generated by said system and implemented by actuators, wherein in an automatic sequence a pavement thickness that is uniform in paving travel direction and a compaction that is uniform in the paving travel direction and also in a direction transverse thereto are controlled without an operator being forced to perform complicated operations or to select parameters. The reason for this is that the control variables, which are implemented at least by actuators for setting the stroke and/or frequency of the tamper, are generated in response to relevant process parameters or machine parameters or paving parameters automatically and in a process-oriented way.

Here, the compaction unit comprises at least one tamper, each with a plurality of connecting rods in each section of the screed, i.e. in the base screed, in each extension screed and, if necessary, also in screed enlarging members attached to the extension screeds. To achieve an even better precompaction, the respective tamper may be combined with an eccentric vibrator that acts on the screed plate or sole plate of the screed with substantially vertically acting eccentric pulses. The vibration frequency may for instance, as is known, be adjustable via a power control valve within a specific range and can be co-adjusted automatically according to the method also in response to the at least one paving parameter. In case the screed also comprises a high-compaction device (see the above-mentioned technical information "Für jede Aufgabe die richtige Einbaubohle", page 8) which operates at high-frequency hydraulic pressure pulses, the frequency and pressing pressure of which are adjustable, the adjustment of the high-compaction device can expediently also be adjusted in response to such paving parameters, so that e.g. at a varying paving speed and/or at an extremely irregular pavement thickness a constantly high final quality of the laid-down pavement can nevertheless be achieved.

Specifically with respect to the aim not to generate significant changes in the pavement thickness in the laid-down pavement and to make the surface flat or even, it is advantageous in an expedient method variant when in addition to the stroke the frequency and/or even the setting angle of the screed is/are automatically adjusted in response to at least one sensed or entered paving parameter. The setting angle is adjusted by means of the leveling cylinders on the paver whereas the frequency of the tamper is e.g. adjusted via the speed of the rotary drive of the tamper, if necessary.

To considerably reduce an operator's work load, either the setting angle of the screed and/or the density and/or the stiffness and/or the temperature of the paving material is sensed expediently according to the method as the paving parameter responsible for the adjustment at least of the stroke of the tamper, preferably by means of at least one sensor, and is preferably compared with a target value before the adjustment of at least the stroke is carried out. The setting angle is e.g. an extremely significant indicator of an optimal compaction that depends essentially on the stroke of the tamper.

In an expedient variant of the method, in addition to the stroke, the frequency of the compaction unit can also be adjusted automatically, preferably along a characteristic curve depending on at least one paving parameter, or in a characteristic map. The automatic frequency adjustment may also encompass an eccentric vibrator. This ensures that both the stroke and the frequency are each optimally related with the paving parameter.

In an expedient variant of the method, the frequency of the tamper is adjusted in conformity with a characteristic curve or a characteristic map, e.g. in direct response to the respectively adjusted stroke. The characteristic curve or the characteristic map, however, can also be based on a predetermined proportionality between the stroke and the frequency, wherein preferably this proportionality is selected in response to at least one paving parameter or a predetermined change in at least one paving parameter, such as e.g. the paving speed, the setting angle of the screed, the density or temperature or stiffness of the paving material, or the like.

In an expedient variant of the method in which the compaction unit comprises a tamper with a tamper bar which is drivable via at least one connecting rod, an eccentric bushing and a driven eccentric shaft at substantially vertical work cycles, the eccentric bushing and the eccentric shaft are rotated relative to each other e.g. even during the ongoing paving work, and the stroke of the tamper bar resulting from the relative rotational position between eccentric bushing and eccentric shaft is adjusted along the characteristic curve or in the characteristic map. The characteristic curve or the characteristic map is defined in advance. The characteristic curve or the characteristic map can be chosen such that the precompaction in the pavement remains at least substantially constant independently of changes in the pavement thickness and/or the paving speed.

Furthermore, according to the method at least the stroke can be adjusted by a control system for which a predetermined precompaction degree is set and into which paving parameters, such as at least the paving speed and/or the pavement thickness, are entered or fed as control variables. The driver of the engine or an operator on the screed need not worry about any adjustments during the ongoing paving work although in a simple variant of the method the adjustment can also be carried out individually by hand. To this end the operator need not manipulate the compaction unit, but this person sets the respective control variable, for instance for the stroke, comfortably on the control system or in the control panel, the control variable being then implemented by an actuator in a corresponding way.

Expediently, the stroke of the tamper bar is here adjusted hydraulically and/or electrically and/or mechanically by an adjusting mechanism arranged between the eccentric shaft and the eccentric bushing, expediently either continuously or in predetermined steps that were previously found to be optimum.

In the screed an adjusting mechanism is expediently provided that is hydraulically and/or electrically and/or mechanically operable and that, possibly even during the ongoing paving work, permits the adjustment of the stroke at any time without requiring any manual intervention.

To this end an automatic, preferably computerized, control system which is operatively connected to the adjusting mechanism and into which paving parameters such as at least the paving speed and/or the pavement thickness are entered or are at least given there and on which e.g. a precompaction degree to be generated by the compaction unit is adjustable may be provided either on the screed or in the road paver. The control system will then adapt the stroke automatically to the evolving changes in at least one paving parameter during the ongoing paving work.

To this end the control system should have at least one characteristic curve depending on paving parameters, or a characteristic map for automatically adjusting the stroke or the stroke and the frequency of the work cycles of the compaction unit.

In an expedient embodiment of the screed the adjusting mechanism is provided between a rotatingly drivable eccentric shaft in the screed and an eccentric bushing which is rotatable on the eccentric shaft in a connecting rod driving the tamper bar at substantially vertical work cycles. The stroke of the tamper bar is thus adjustable by way of a relative rotational adjustment between the eccentric bushing and the eccentric shaft. Depending on the relative rotational position of the eccentric bush on the eccentric shaft, half the stroke of a work cycle results from the sum of the eccentricity of an eccentric section of the eccentric shaft and a portion up to the maximum of the eccentricity of the eccentric bushing.

In another expedient embodiment of the screed the adjusting mechanism is arranged between a rotatingly drivable eccentric shaft in the screed and an eccentric bushing which is arranged on the eccentric shaft in a rotationally fixed manner, but is movable in a direction transverse to the axis of the eccentric shaft, and which is rotatably supported in a connecting rod driving the tamper bar, in such a manner that the stroke is adjustable by a transverse displacement of the eccentric bushing relative to the eccentric shaft. The extent of eccentricity of the eccentric bushing that will then become operative depends on the extent of the transverse displacement of the eccentric bushing relative to the eccentric shaft. The eccentric bushing has an eccentric effect, but may also have a circular cylindrical configuration.

In a further expedient embodiment of the screed, the adjusting mechanism is arranged between a bearing block supporting a rotatingly drivable eccentric shaft, and an adjusting lever which is articulated to a connecting rod driving the tamper bar and is adjustable within the bearing block (toggle principle), wherein the adjusting lever and a push rod which is drivable by the eccentric shaft are coupled in a joint articulation axis with the connecting rod in such a manner that an adjustment of the adjusting lever in the bearing block changes the effective stroke of the tamper bar that is generated via the push rod by the rotation of the eccentric shaft.

In the embodiment with the eccentric bushing that is rotatable relative to the eccentric shaft, an axially adjustable driver is supported in a rotationally fixed manner expediently in the eccentric shaft and engages into a thread-like guide path of the eccentric bushing that is rotatable on the eccentric shaft. When the driver is adjusted, preferably electrically and/or hydraulically and/or mechanically in the axial direction of the eccentric shaft, the eccentric bushing is rotated via the thread-like guide path and is again rotationally fixed in the respectively selected setting.

In an alternative embodiment an axially movable adjusting mechanism is arranged in the eccentric shaft in a rotationally fixed manner and cyclically operates a rotary type step switching mechanism cooperating with the rotatably supported eccentric shaft so as to rotate the eccentric bushing in steps relative to the eccentric shaft and to couple it in the selected rotary position in a rotationally fixed manner with the eccentric shaft.

In a further alternative embodiment a clamping mechanism may be provided between the eccentric shaft and the eccentric bushing, the clamping mechanism coupling the eccentric bushing in a force-fit or friction-fit or form-fit manner with the eccentric shaft and being temporarily movable into a release position by an axial release mechanism supported in the screed, in which release position the coupling between the eccentric shaft and the eccentric bushing is decoupled and said two components are rotatable relative to each other or are rotated automatically.

In a further expedient embodiment with the eccentric bushing being shiftable in a direction transverse to the axis of the eccentric shaft, the eccentric shaft and the eccentric bushing coupled with the eccentric shaft in a rotationally fixed manner have arranged thereinbetween at least one guide block which is adjustable in a direction transverse to the eccentric shaft by means of at least one control rod, which is axially shiftable in the eccentric shaft, and which carries the eccentric bushing and is provided with an inclined guide surface. The guide block is shifted via the inclined guide surface in a direction transverse to the axis of the eccentric shaft so as to adjust the eccentric bushing and to change its effective portion of eccentricity. The eccentric bushing need here not be configured to be eccentric, but it may also be cylindrical.

It is here expedient when the inclined guide surface of the guide block, especially of two diametrically opposite guide blocks, abuts on an inclined ramp either in the eccentric bushing or on the control rod in an axially shiftable manner.

In an expedient embodiment in which the tamper bar is driven via a toggle mechanism, the bearing block comprises a straight or arcuate guide path which is engaged by a pivot abutment of the adjusting lever that is shiftable by means of the adjusting mechanism along the guide path and is fixed in selected adjusting positions, with the direction of extension of the guide path being oriented at least approximately towards the axis of the eccentric shaft. The adjustment of the pivot abutment of the adjusting lever results in a change in the tamper bar stroke sensed on the eccentric shaft. In this instance it is expedient when the guide path is arranged on the connecting rod relative to the axis of the eccentric shaft and the articulation axis on the connecting rod in such a manner that a lower dead center of the work cycle which is induced by the eccentric shaft and pertains to the tamper bar connected to the connecting rod remains stationary independently of the adjusting position of the pivot abutment of the adjusting lever along the guide path, preferably or for instance stationary in relation to a sole plate mounted on a frame of the screed carrying the bearing block. This means that only the upper dead center of the work cycle is adjusted in upward direction and the position of the lower dead center does not change relative to the sole plate during adjustment of the stroke.

To be able to sense paving parameters or changes in paving parameters and to transmit them to the control system or enter them into said system, at least one sensor, preferably a plurality of sensors distributed in the paving travel direction or in a direction transverse thereto, is/are provided for detecting actual paving parameters in an expedient embodiment of the road paver on the road paver itself and/or the screed and/or the bars, with the sensors being coupled or adapted to be coupled with the control system. Since at least relevant paving parameters, such as at least the setting angle of the screed, or changes thereof, can be detected via the sensors and can be transmitted to the control system, the operator's work load is diminished, and a uniformly high quality of the laid pavement is achieved.

In a further expedient embodiment an input and display section is provided on the road paver and/or the screed on the control system or on a machine controller coupled with the control system for additionally or alternatively setting magnitudes, values or parameters, at least for the stroke and/or the frequency, but also the setting angle of the screed, which is usable by the operator for entering additional information into the control system in response to the requirements.

BRIEF DESCRIPTION OF THE DRAWINGS

Embodiments of the subject matter of the invention are explained with reference to the drawings, in which.

DETAILED DESCRIPTION OF THE INVENTION

Figure 1:
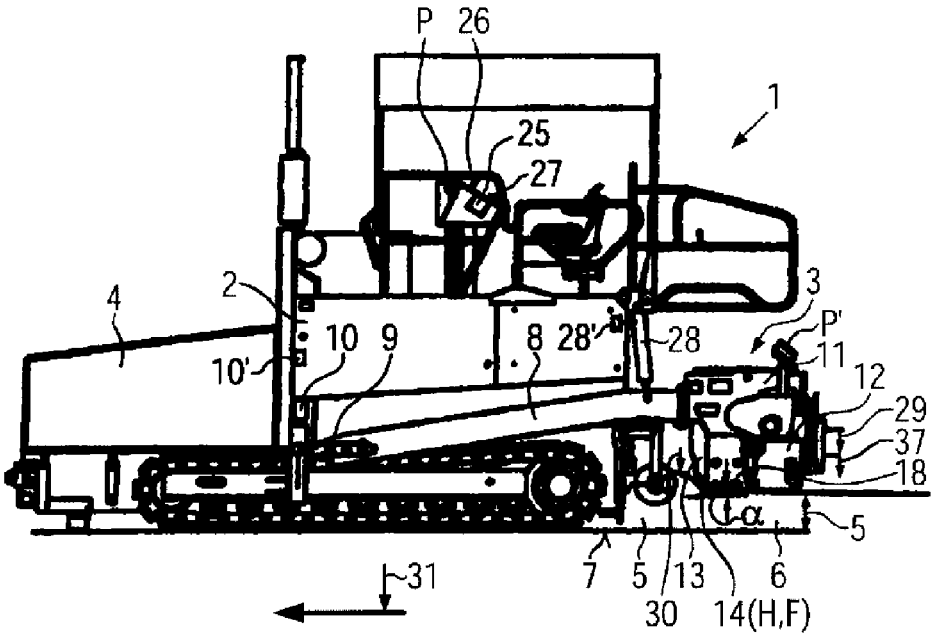
FIG. 1 is a schematic side view of a road paver equipped with a screed while laying down a pavement.

A road paver 1 in FIG. 1 for laying down a pavement 6 of a bituminous or concrete-type paving material 5 on a subgrade 7 is equipped on a chassis 2 with a paving material hopper 4 and in a driver's cab with a control panel P of a controller, e.g. with a control system 25. As an alternative, the control system 25 could also be arranged at a different place inside the road paver 1 or in a screed 3 towed by the road paver, namely in functional association with the controller or the control panel P or an external control panel P' arranged on the screed 3.

The screed 3 is fastened to traction bars 8 that at both sides are connected to articulation points 9 of the road paver 1. The articulation points 9 can be moved upwards and downwards via adjusting devices 10, such as leveling cylinders, for instance in order to adjust the pavement thickness S of the laid-down pavement 6. The screed 3 comprises, for instance, a base screed 11 and extension screeds 12 movable on said base screed, each with a compaction unit 13 comprising at least a tamper 14 and a tamper bar, respectively, and a sole plate 18 acting on the paving material 4, wherein preferably the screed 3 floatingly operates at a small positive setting angle $\alpha$ relative to a plane in parallel with the subgrade 7. The tamper bar 14 is cyclically drivable at work cycles for precompaction and carries out strokes H at a frequency F. During the ongoing paving work the road paver 1 is running at a paving speed V on the subgrade 7.

If necessary, the screed 3 (in the base screed 11 and each extension screed 12) additionally includes at least one eccentric vibrator (not shown) for acting on the sole plate 18 with vertical pulses, and optionally in work travel direction at the rear side at least one pressing bar of a high-performance compaction device (not shown). The eccentric vibrator and the high-performance compaction device are selective options of a screed 3 whereas the tamper 14 can pertain to the basic equipment.

The paving speed V and also the pavement thickness S are paving parameters that are changing or can be changed optionally even during the ongoing paving work. The tamper 14 must produce a precompaction in the paving material 5 that has loosely been poured onto the subgrade 7, and the precompaction should be kept at least predominantly constant independently of varying paving parameters. Further paving parameters that might be of relevance to precompaction may be type and consistency of the paving material 5, the temperature thereof, ambient conditions, the design of the screed 3, or the like.

According to the invention the precompaction is kept substantially constant, independently of the paving parameters varying during the ongoing paving work, in that at least the stroke H of the work cycles of the tamper 14 is adjusted in response to at least one paving parameter, optionally even automatically, expediently also the frequency F, namely via the control system 25 that receives or is aware of at least one paving parameter as a control variable, and on which preferably a desired precompaction degree is set as a setpoint or target value. The control system 25 can be operated with characteristic curves and/or a characteristic map. Each characteristic curve or the characteristic map is predetermined and stored. Expediently, the control system 25 is an automatic one and is computerized.

Figure 2:
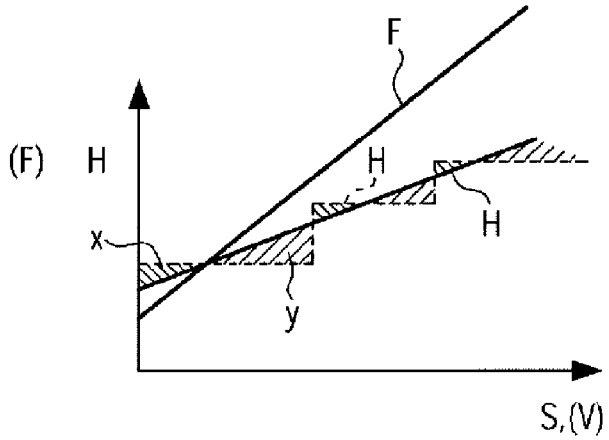
FIG. 2 is a diagram for illustrating two characteristic curves or a characteristic map.

FIG. 2 shows a diagram of the stroke H (or of the frequency F) over the pavement thickness S (or the paving speed V). The continuous characteristic curve H illustrates how the stroke H is here continuously increasing with an increasing pavement thickness S (or with an increasing paving speed V). The broken lines outline the measure known from the prior art, i.e. to change the stroke H in several steps, each with an interrupted paving operation, wherein the obliquely hatched fields X and Y illustrate that the stroke H changed according to the staircase profile, or the precompaction, is not matching over a considerable portion of the changes made in the pavement thickness S or the paving speed V.

The continuous characteristic curve F illustrates the also possible change in the frequency with an increasing pavement thickness S or paving speed V. The characteristic curves H, F can be stored in a characteristic map executed by the control system 25 during the ongoing paving work. The characteristic curve F, H or the characteristic map is predetermined such that with respect to a high and constant final quality of the laid-down pavement 6 there is always an optimum ratio between the pavement thickness and/or the paving speed and at least the stroke H; expediently, the frequency F is also optimal. The stroke H and optionally also the frequency F are expediently adjusted either automatically and even during the ongoing paving work while changes in at least one paving parameter such as the pavement thickness S and/or the paving speed V are sensed, or in an operator-controlled manner.

Figure 3:
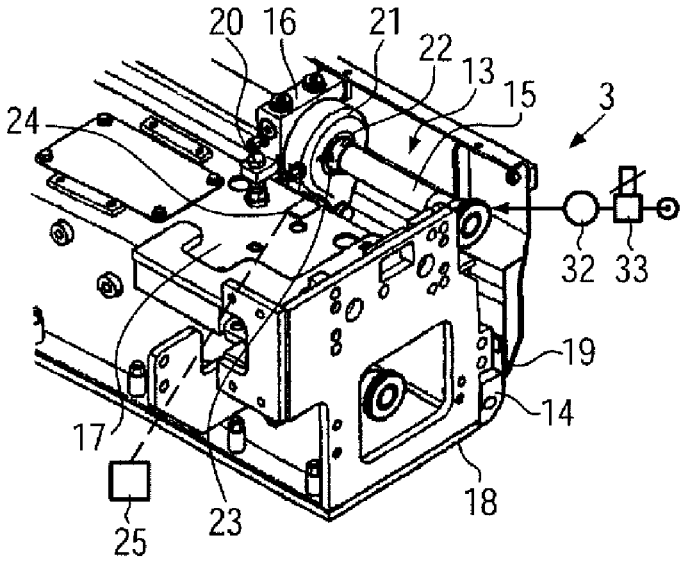
FIG. 3 is a perspective view showing a part of a screed equipped with a compaction unit.

FIG. 3 illustrates an inner portion of the screed 3 with the tamper 14. The tamper bar 14 is shielded on the front side of the screed 3 by a cover 19 (draw-in snout) and is substantially vertically movably guided between the cover 19 and the front edge of the sole plate 18. On a frame 17 of the screed 3 that carries the sole plate 18 on the bottom, a bearing block 16 is mounted having a relative height position that can e.g. be adjusted by means of an adjusting screw 20 in such a manner that the tamper bar 14 in the lower dead center of each work cycle occupies a specific relative position with respect to the sole plate 18. In the bearing block 16 (a plurality of bearing blocks 16 may be mounted over the length of the frame 17) an eccentric shaft 15 is rotatably supported and includes a respective eccentric section 22 with a specific eccentricity. The eccentric section 22 is located in a connecting rod 21 which connects the eccentric shaft 15 to the tamper bar 14. On the eccentric section 22 of the eccentric shaft 15, an eccentric bushing 23 is coupled in a rotationally fixed manner with the eccentric section 22, for instance in the illustrated embodiment via an adjusting mechanism 24 supported on the frame 17, and is rotatably supported in the connecting rod 21. With the help of the adjusting mechanism 24 the eccentric bushing 23 can be rotated relative to the eccentric section 22 of the eccentric shaft 15 and can be coupled again in a rotationally fixed manner with the eccentric shaft 15 in the respectively adjusted rotary position. The relative rotation of the eccentric bushing 23 relative to the eccentric section 22 effects an adjustment of the stroke which is transmitted by the connecting rod 21 to the tamper bar 14. The stroke can be adjusted preferably automatically via the control system 25 which is in operative communication with the adjusting mechanism 24, namely depending on changes in specific paving parameters. Alternatively, the adjusting mechanism 24 could also be controlled or actuated by an operator, if necessary.

The illustration of the adjusting mechanism 24 in FIG. 3 is schematic because the adjusting mechanism 24 must of course act due to the rotational direction of the eccentric shaft 15 indirectly as a stroke adjusting device via the eccentric shaft 15 on the eccentric bushing 23. This shall be explained in detail with reference to the further embodiment.

Figure 4:
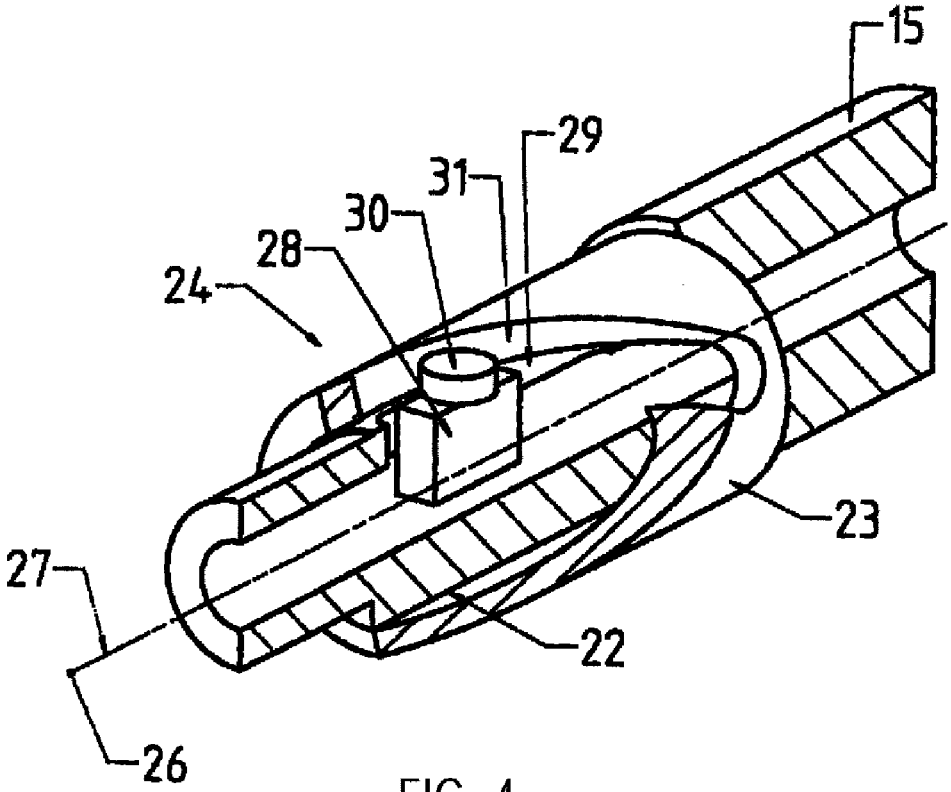
FIG. 4 is a perspective sectional illustration showing an embodiment of a stroke adjusting device.

In the adjusting mechanism 24 shown in FIG. 4, the eccentric bushing 23 is rotatably seated on the eccentric section 22 of the eccentric shaft 15. The shaft is e.g. hollow in such a way that an interior control rod 27 leads to an adjusting drive 26 located outside of the eccentric shaft 15. The control rod 27 is coupled with a driver 28 which is adjustable in a groove 29 axially in the eccentric shaft 15 and is connected to said shaft in a rotationally fixed manner and which with an extension 30 projecting out of the groove 29 to the outside engages into a thread-like guide path 31 of the eccentric bushing 23.

The eccentric section 22 exhibits a first eccentricity relative to the rotational axis of the eccentric shaft 15, but is cylindrical on the outer circumference. The cylindrical outer circumference of the eccentric bushing 23 is eccentric relative to the cylindrical inner circumference. Since the cylindrical outer circumference of the eccentric bushing 23 is rotatable in the connecting rod 21, and since the tamper bar 14 is movable in a fixed vertical plane, the extent of the eccentricity resulting from the first and second eccentricities depends on which relative rotational position is set between the eccentric bushing 23 and the eccentric section 22. The efficient eccentricity extent determines half the stroke H of a work cycle. Hence, when the driver 28 is moved towards the axis of the eccentric shaft 15, the stroke H can be adjusted in a continuously variable manner between a minimum and a maximum. The eccentric bushing 23 always remains coupled with the eccentric shaft 15 in a rotationally fixed manner. The adjusted axial position of the driver 28 is e.g. maintained by the adjusting drive 26.

The eccentric shaft 15 is rotatably supported e.g. at the left end in FIG. 4 in a bearing block (which is here not shown) and is driven from the end at the right side in FIG. 4 via a hydromotor (not shown). The adjusting drive 26 can thus be arranged in front of the end at the left side in FIG. 4 in the screed or on the frame 17.

Figure 5:
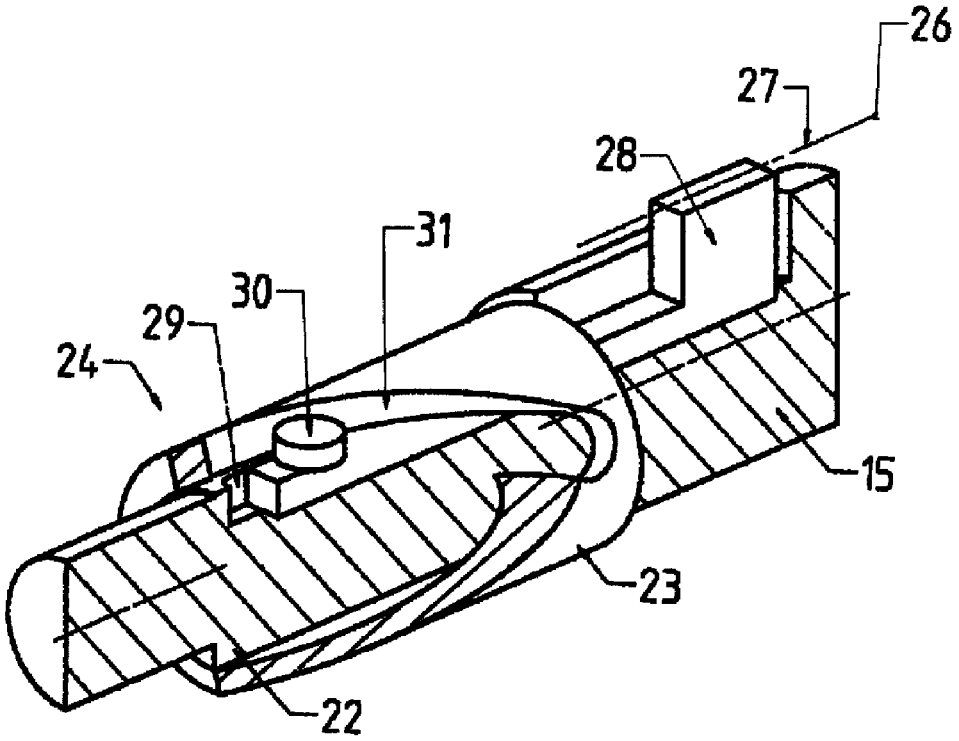
FIG. 5 is a perspective partial sectional view showing a further embodiment of a stroke adjusting device.

FIG. 5 mainly differs from FIG. 4 in that the adjusting mechanism 24 contains the driver 28 which is axially displaceable in the outwardly open groove 29 of the eccentric shaft 15, in such a matter that the adjusting drive 26 is operative via the control rod 27 from the outside of the eccentric shaft 15. The extension 30 of the driver 28 engages into the thread-like guide path 31 of the eccentric bushing 22 which, though it is seated in a relatively rotatable manner on the eccentric section 22 of the eccentric shaft 15, remains coupled with the eccentric shaft 15 in a rotationally fixed manner via the driver 28, the groove 29 and the extension 30 in each axial position of the driver 28.

Figure 6:
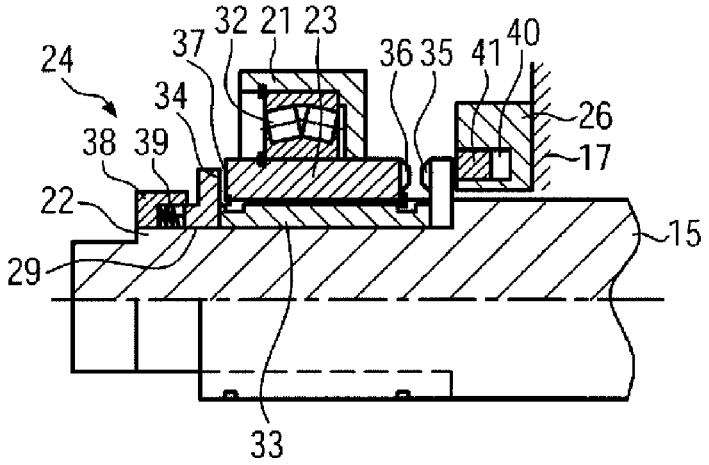
FIG. 6 is a longitudinal section through a further embodiment of a stroke adjusting device.

The adjusting mechanism 24 shown in FIG. 6 comprises a rotary type step switching mechanism which is cyclically operated by the adjusting drive 26, which is e.g. supported on the frame 17 of the screed, so as to rotate the eccentric bushing 23 relative to the eccentric section 22 of the eccentric shaft 15. In the connecting rod 21 the eccentric bushing 23 is rotatably supported via at least one roller bearing 32. In the eccentric section 22, at least one axial groove 29 is provided having arranged therein an adjusting mechanism 33 which is coupled with the eccentric shaft 15 to be axially movable, but rotationally fixed. At the left end of the adjusting mechanism 33 in FIG. 6 a sawtooth gearing 34 (circumferential gearing) is provided, as well as a sawtooth gearing 35 that is circumferentially offset relative thereto and provided at the right end of the adjusting mechanism 33. The eccentric bushing 23 has corresponding sawtooth gearings 37 and 36, respectively, at both ends. The axial length of the eccentric bushing 23 between the sawtooth gearings 36, 37 thereof is slightly shorter than the inner width between the sawtooth gearings 35, 34. The adjusting mechanism 33 is hydraulically axially adjustable through this width difference for instance by means of a ring piston 41 of the adjusting drive 26 (hydraulically actuatable ring chamber 40). The left-side end of the adjusting mechanism 33 is supported on a spring 39 of a stop 38 on the eccentric shaft 15.

For rotating the eccentric bushing 23 on the eccentric section 22 the adjusting mechanism 33 is moved by the ring piston 41 out of the position shown in FIG. 6 to the left side until the gearings 34, 37 are disengaged and the gearings 35, 36 are meshing with each other. The eccentric bushing 23 is thereby rotated by a pitch by way of a circumferential displacement between at least the gearings 34 and 35. The pressure is thereafter reduced in the ring chamber 40 so that the spring 39 shifts the adjusting mechanism 33 back into the position shown in FIG. 6, and e.g. the eccentric bushing 23 is further rotated by a further pitch and is thereafter again coupled in a rotationally fixed manner with the eccentric section 22.

Figure 7:
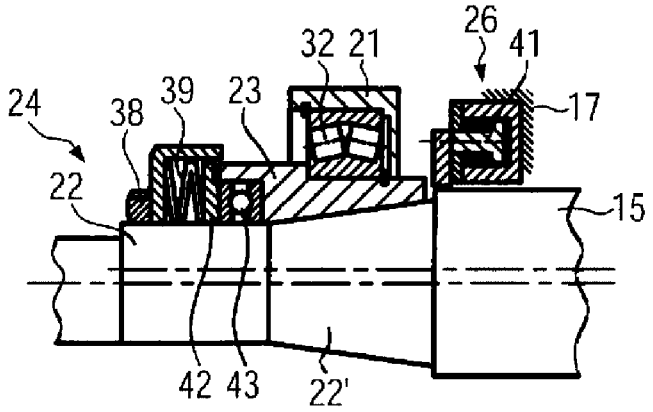
FIG. 7 is a longitudinal section through a further embodiment of a stroke adjusting device.

In FIG. 7, the adjusting mechanism 24 comprises the ring piston 41 as the adjusting drive 26. The adjusting drive 26 can be supported on the frame 17 of the screed. The ring piston 41 directly acts on an axial end of the eccentric bushing 23, which bushing 23 is pressed by the spring 39, which is supported on the stop 39 on the eccentric shaft 15, via a stop ring 42 and a roller bearing 43 axially onto a conical section 22' of the eccentric section 22 of the eccentric shaft 15 and coupled with the eccentric shaft 15 in a rotationally fixed manner. The eccentric bushing 23 can be moved to the left side against the force of the spring 39 by the ring piston 41 out of the position shown in FIG. 7, so that the friction connection with the conical section 22' is disconnected or loosened, and for instance the eccentric shaft 15 can be rotated in the roller bearing 43 relative to the eccentric bushing 23 until the ring piston 41 is retracted again and the eccentric bushing 23 is brought by the spring 39 into renewed frictional contact with the conical section 22'. Alternatively, for instance in a way similar to the one in FIG. 6, the relative rotational movement could also be carried out on the eccentric bushing 23. The connecting rod 21 follows these minor axial movements of the eccentric bushing 23 in the embodiment in FIG. 7. Alternatively, the roller bearing 32 could have an axial play in the connecting rod 21 or on the eccentric bushing 23. In an alternative (not shown), the eccentric bushing 23 could even be coupled through a gearing with the conical section 22' in a rotationally fixed manner.

Figure 8:
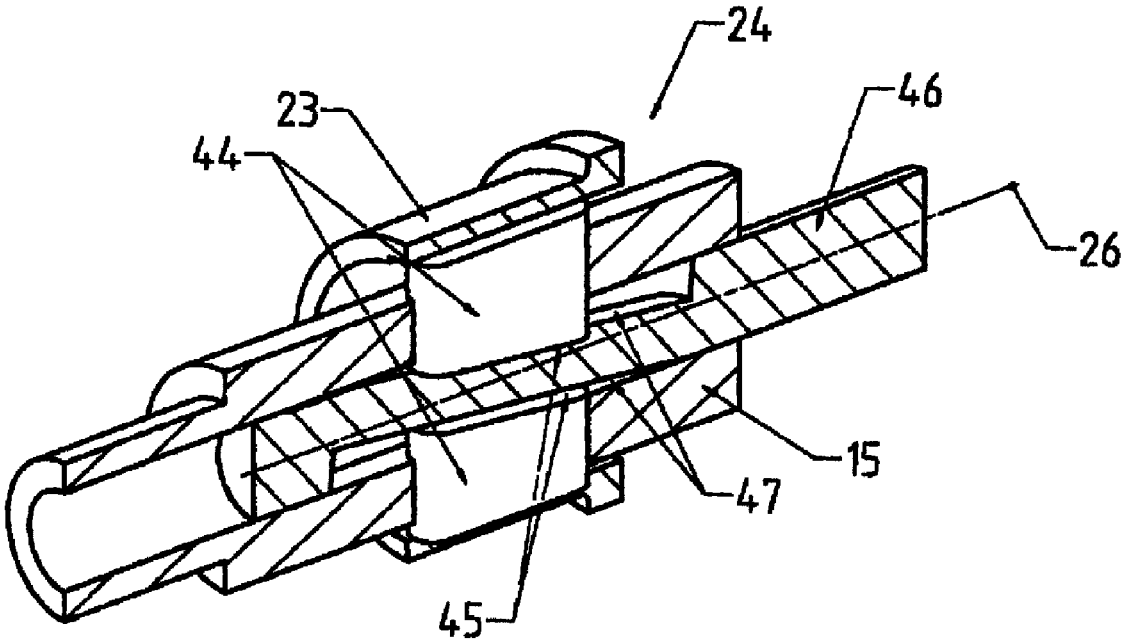
FIG. 8 is a perspective sectional view showing a further embodiment of a stroke adjusting device.

In the embodiment shown in FIG. 8 and regarding the stroke adjusting device with the adjusting mechanism 24, and in contrast to the previously described embodiments of FIGS. 4 to 7, the eccentric bushing 23 is not rotated relative to the eccentric section 22 of the eccentric shaft 15, but it is shifted in a direction transverse to the axis of the eccentric shaft 15 so as to change the whole efficient eccentricity and thus the stroke.

The eccentric bushing 23 can e.g. be configured with coaxial inner and outer cylindrical circumferences, i.e. in a circular cylindrical manner, and arranged in a rotationally fixed manner on two opposite guide blocks 44 that are shiftable in outwardly open grooves of the pierced eccentric shaft 15 in a direction transverse to the axis of the eccentric shaft 15 and are rotationally fixed with the eccentric shaft. Each guide block 44 is provided on the inside with an inclined guide surface 45 that is standing on an inclined guide ramp 47 of a control rod 46 which is axially displaceable in the eccentric shaft 15 by means of the adjusting drive 26 and fixable in the respectively selected adjusting position. The adjusting drive 36 can be configured hydraulically, electrically or mechanically. Although the eccentric bushing 23 is cylindrical (which is advantageous under technical manufacturing aspects), it exhibits an eccentric action relative to the eccentric section 22.

Figure 9:
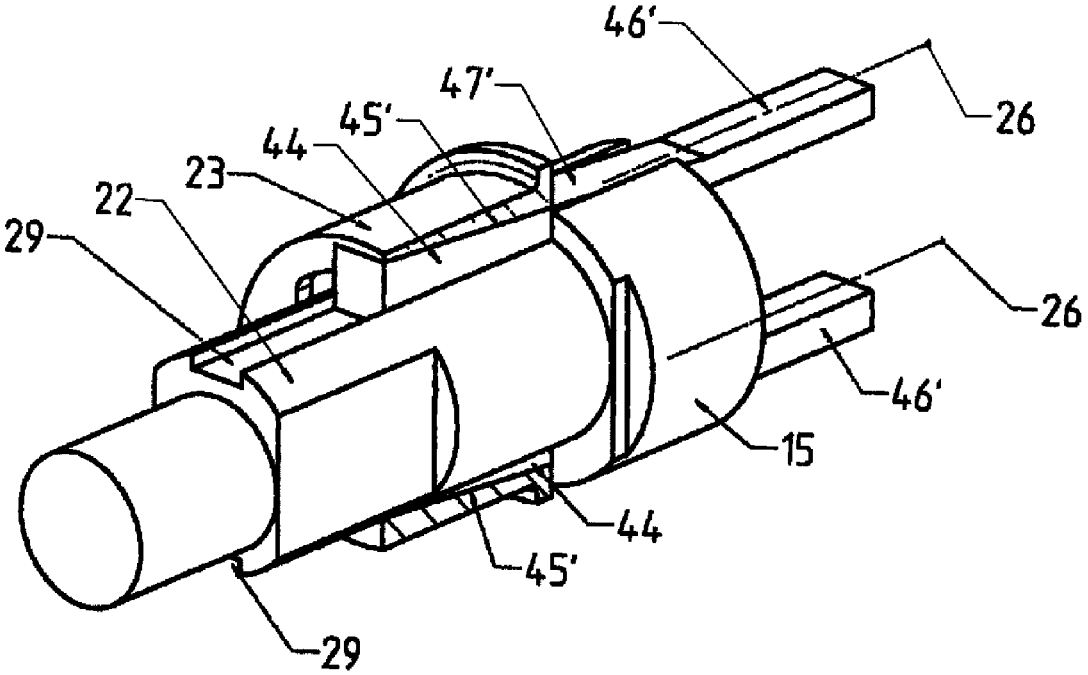
FIG. 9 is a perspective sectional illustration showing a further embodiment of a stroke adjusting device.

In the embodiment of FIG. 9, which is functionally similar to the embodiment of FIG. 8, two diametrically opposite axial grooves 29 are formed in the eccentric section 22 of the eccentric shaft 44, the guide blocks 44 being coupled in said grooves with the eccentric shaft 15 in an axially movable and rotationally fixed manner. Each guide block 44 is engaged by a control rod 46' which is or can be coupled with the adjusting drive 26. The inclined guide surface 47' is formed on the outside on the guide block 44 and engages into an axial groove on the inner surface of the eccentric bushing 23. The inclined guide ramp 45' is formed in said axial groove, so that the eccentric bushing is shifted, similar to the way shown in FIG. 8, in a direction transverse to the axis of the eccentric shaft by the axial displacement of the guide blocks 44 and remains coupled in a rotationally fixed manner with the eccentric shaft 15. In this instance, too, the eccentric bushing 23 can be cylindrical.

Figure 10:
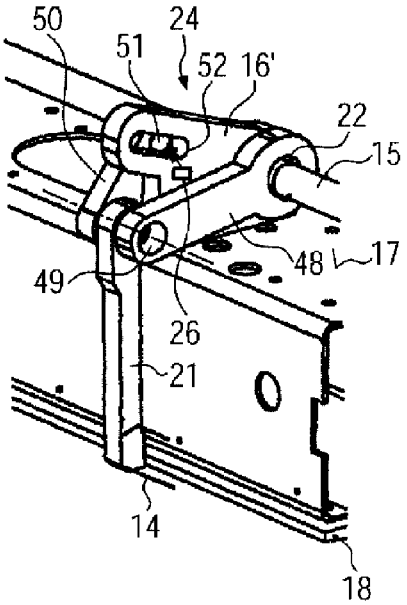
FIG. 10 is a perspective view of a further embodiment of a stroke adjusting device.

In FIG. 10, the adjusting mechanism 24 is integrated into a toggle mechanism via which the rotational movement of the eccentric shaft 15 with its eccentric section 22 is transmitted via a push rod 48 rotatably supported on the eccentric section 22 and via an articulation axis 49 to the connecting rod 21 on which the tamper bar 14 is secured. An end of an adjusting lever 50 is articulated to the connecting rod 21, preferably on the same articulation axis 49, the adjusting lever being supported with a pivot abutment 51 (e.g. a pin) in a guide path 52 of the bearing block 16' of the eccentric shaft 15. The bearing block 16' can be mounted on the frame 17 of the screed. The guide path 52 is e.g. a straight or arcuate elongated slit in the bearing block 16' and extends in a plane which transversely cuts the eccentric shaft 15. The adjusting drive 26 is operative between the bearing block 16' and the pivot abutment 51 so as to adjust the pivot abutment 51 inside the guide path 52. This changes the eccentricity sensed on the eccentric section 22 and transmitted by the adjusting lever 50 to the connecting rod 21, or the stroke of the tamper bar 14, respectively.

Expediently, the guide path 52 is configured and arranged relative to the axis of the eccentric shaft 15 and the articulation axis 49 such that independently of the adjusting position of the pivot abutment 51 in the guide path 52 the lower dead center of the work cycles of the tamper bar 14 remains stationary in relation to the sole plate 18, i.e. in the stroke adjustment only the upper dead center shifts.

The rotation of the eccentric shaft 15 reciprocates the push rod 48 substantially in parallel with the upper side of the frame 17 via the eccentric shaft 22. Said swing movement effects a pivotal movement of the adjusting lever 50 about the pivot abutment 51 via the joint articulation axis 49, said pivot movement describing a circular-arc section. The adjusting lever 50 derives therefrom a substantially vertical stroke component for the connecting rod 21. The extent of this stroke component is changed by adjusting the pivot abutment 51 in the guide path 52.

The articulation points 9 of the traction bars 8 of the road paver 1 of FIG. 1 are adjustable in their height with the leveling cylinders 10 e.g. via actuators 10' (hydraulic valves or the like) and influence the setting angle $\alpha$ of the screed 3. The setting angle $\alpha$ should be positive, but have an optimal size, i.e. not too flat and not too steep, and its optimal size is maintained by the control system 25. Lifting cylinders 28 are additionally hinged to the chassis 2, the lifting cylinders acting on the traction bars 8 and serving to position the screed 3 in a lifted position for instance for transportation travel, or to carry out a screed relief or optionally to intensify the support pressure of the screed 3. The tamper 14 of the compaction unit 13 is (see FIG. 3) for instance operable by means of an eccentric drive with selectable stroke H and selectable frequency F.

In the control panel P or external control panel P' a speed selector 26 is provided for setting the paving speed V. The speed selector 26 can be adjusted via an actuator (not shown) and optionally by the control system 25 so as to vary the paving speed V. The paving speed V is sensed by a symbolically illustrated sensor 41 and transmitted to the control system 25. The sensor 31 can be placed in the road paver e.g. in the control panel P or in a travel drive or it may sense a reference on the subgrade 7. In the control panel P or in the control system 25 an input section 27 may be provided for the input of parameters and/or for the display of parameters. The lifting cylinders 28 have assigned thereto at least one actuator 28', e.g. a magnetically operated hydraulic valve. Furthermore, at least one sensor 30 may be provided as equipment for the road paver 1, the sensor sensing the temperature, density or consistency of the paving material, e.g. directly in front of the screed 3, and transmitting these values as information to the control system 25, if necessary. This sensed information could also be input by an operator. For instance, the screed 3 has disposed thereon at least one sensor 29 that senses the setting angle α of the screed relative to the subgrade 7. Sensor 29 could also sense the setting angle α on the traction arms 8. A plurality of sensors 29 can be provided across the pave width. Furthermore, a sensor 37 can be provided for sensing the pavement thickness S, the sensor sensing for instance the subgrade 7 or a reference (not shown) on the subgrade 7.

In the road paver 1 or the screed 3, actuators are provided for setting the tamper stroke H or the tamper frequency F, respectively, and can be prompted by control signals generated by means of the control system 25 to implement control signals. For instance, FIG. 3 shows the mechanism 24 forming an actuator for the tamper stroke H for rotating the eccentric bushing 23 relative to the eccentric section 22. The adjustment of the tamper stroke H, which is each time matched to the pave parameters, is carried out automatically via the control system 25. The eccentric shaft 15 is rotationally driven for instance by a hydromotor 32. The speed thereof defines the tamper frequency F. A magnetically operated valve may serve as an actuator 33 for the hydromotor 3, i.e. a proportional current-regulating valve that can be actuated by the control system 25 with control signals.

With the help of the control system 25 a plurality of different machine or site or paving-material parameters are automatically controlled depending on one another so as to minimize, for instance, error rates in the laid pavement 6 and to enhance the quality of the laid pavement 6.

The tamper 14 has compacted the loosely pre-laid paving material 5 to such a degree that a bearing capacity is created that is adequate for the screed 3. It is only then that it is ensured that the screed 3 with its sole plate 18 is floatingly towed at an advantageous setting angle α. The tamper stroke H, the tamper frequency F, the paving speed V and the setting angle α depend on one another to a great degree. For instance, if the paving speed V is reduced, this will have an effect on the precompaction of the paving material at a constant tamper frequency and leveling cylinder adjustment. The bearing capacity of the paving material is increasing, so that the screed 3 is further floating and the setting angle α is decreasing. By contrast, if the paving speed is increased without increasing the tamper frequency, the bearing capacity of the paving material will decrease and the screed will perform the paving operation at a greater setting angle α, but at a smaller pavement thickness S. To minimize or avoid such influences on the final quality of the laid pavement 6, control variables for at least the compaction unit 13 and the tamper 14, respectively, are automatically controlled and regulated according to the invention by the control system 25 depending on the relevant processes or machine parameters. To be more specific, a uniform and optimal compaction of the paving material over the whole pave width of the screed is thereby achieved as a contribution to quality assurance.

For instance, the setting angle α is sensed by means of the sensor 29 or a plurality of sensors 29 distributed in transverse direction and is transmitted to the control system 25 or a controller specifically in charge of this pave parameter so as to adapt the tamper stroke H upon change in the setting angle α, so that the setting angle α is returned again to an optimal value or cannot change significantly, thereby achieving the desired pavement thickness S with a permanently optimal precompaction.

As a secondary aspect, the setting angle α may vary over the transverse paving width of the screed 3. The control system 25 can then adapt the tamper stroke H for each tamper 14 individually in a corresponding way, so that despite a pavement thickness S varying in a direction transverse to the pave travel direction the compaction remains uniform over the pave width.

In consideration of the sensed setting angle α or the sensed changes thereof, it is furthermore possible to adapt the tamper stroke H and the tamper frequency F via the control system 25, and optionally additionally to adjust the leveling cylinders 10 in addition or as an alternative to an adaptation of the tamper frequency F.

The tamper frequency F can be adapted in a particularly simple way in that upon change in the tamper stroke H the tamper frequency F is adapted automatically in conformity with a characteristic curve or in a characteristic map that is entered into or exists in the control system.

A relevant paving parameter is e.g. also the density or consistency of the paving material 5. If the road paver 1 is equipped with a sensor 30, as mentioned, by means of which the density or consistency of the paving material can be sensed, the sensed value is compared with a target value and in case of a deviation from the target value an adaptation e.g. of the tamper stroke H and/or the tamper frequency F and/or the leveling cylinder setting is carried out via the control system 25 in such a way that upon deviation of the sensed density or consistency the setting angle is substantially maintained and the same compaction and evenness and thus quality of the pavement 6 is achieved.

Likewise, the paving speed V is also an important paving parameter because in case of a change in paving speed an adaptation of the tamper stroke H and/or the tamper frequency F and/or the leveling cylinder setting, e.g. via the automatic control system 25, is needed.

A further relevant paving parameter is the stiffness of the paving material 5 and/or the temperature thereof. These paving parameters can e.g. be sensed individually or in combination by means of the sensor 30 or a stiffness and a temperature sensor and transmitted to the control system 25, or after detection they can be entered by an operator on section 27, whereupon the control system, if recommended by the sensed values, adapts the tamper stroke H and/or the tamper frequency F and/or the leveling cylinder setting accordingly. As an additional or alternative adaptation, it is also possible to carry out an adjustment on the lifting cylinders 28, e.g. in order to relieve the screed 3 during the paving work to a greater extent or to load it particularly towards the subgrade 7, again with the intention to keep the setting angle α as uniform as possible and to make the screed 3 work with a uniform compaction of the pavement 6.

In essence, such automation minimizes error rates and costs and improves the quality, a considerable work reduction for the operator(s) of the road paver being an automatic, but welcome, consequence of this method.

The invention claimed is:

1. A screed for road pavers, comprising a compaction unit with a tamper bar driven by an eccentric drive in cyclical work cycles with a selectable stroke and at a selectable frequency relative to a sole plate of the screed for precompacting a pavement made from paving material, wherein the eccentric drive in the compaction unit comprises an adjusting drive for the remote-controlled automatic adjustment of the stroke of the tamper bar, wherein the adjusting drive cooperating with a rotatingly drivable eccentric shaft and an eccentric bushing arranged on the eccentric shaft in a rotationally fixed manner being displaceable in a direction transverse to the axis of the eccentric shaft, the eccentric bushing being rotatable in a connecting rod driving the tamper bar, such that the stroke of the tamper bar is adjustable by a transverse displacement of the eccentric bushing relative to the eccentric shaft, the eccentric shaft and the transversely adjustable eccentric bushing coupled by guide blocks with the eccentric shaft in a rotationally fixed manner have provided therein the guide blocks adjustable in a direction transverse to the eccentric shaft by means of at least one control rod of the adjusting drive, the control rod being guided in the eccentric shaft in an axially shiftable manner, each of the guide blocks having an inclined guide surface, and wherein each inclined guide surface of a respective guide block radially abuts in an axially moveable manner on an inclined ramp in the eccentric bushing or on the control rod.

2. Screed according to claim 1, wherein the adjusting mechanism is operable hydraulically, electrically or mechanically, either continuously or stepwise during the pavement laying operation.

3. Screed according to claim 1, comprising an automatic control system connected to sensors for detecting actual paving parameters and being operatively connected to the adjusting mechanism, and into which control system paving parameters for at least one of the paving screed, the pavement thickness and a target pre-compacting degree producible by the compaction unit can be entered or stored.

4. Screed according to claim 3, wherein the control system comprises at least one characteristic curve representing paving parameters for automatically adjusting the stroke in response to paving parameters.

5. Screed according to claim 3, wherein the control system comprises a characteristic map representing paving parameters for automatically adjusting the stroke in response to paving parameters.

6. A screed for road pavers, comprising a compaction unit with a tamper bar driven by an eccentric drive in cyclical work cycles with a selectable stroke and at a selectable frequency relative to a sole plate of the screed for pre-compacting a pavement made from paving material, wherein the eccentric drive in the compaction unit comprises an adjusting drive for the remote-controlled automatic adjustment of the stroke of the tamper bar, wherein the adjusting drive cooperating with a rotatingly drivable eccentric shaft and an eccentric bushing arranged on the eccentric shaft in a rotationally fixed manner being displaceable in a direction transverse to the axis of the eccentric shaft, the eccentric bushing being rotatable in a connecting rod driving the tamper bar, such that the stroke of the tamper bar is adjustable by a transverse displacement of the eccentric bushing relative to the eccentric shaft, wherein the eccentric shaft and the transversely adjustable eccentric bushing coupled by guide blocks with the eccentric shaft in a rotationally fixed manner have provided therein the guide blocks adjustable in a direction transverse to the eccentric shaft by means of at least one control rod of the adjusting drive, the control rod being guided in the eccentric shaft in an axially shiftable manner, each of the guide blocks having an inclined guide surface, and wherein each inclined guide surface of a respective guide block radially abuts on an inclined guide ramp of the at least one axially shiftable control rod.

* * * * *